US005354142A

United States Patent [19]

Yu

[11] Patent Number: 5,354,142

[45] Date of Patent: * Oct. 11, 1994

[54] RING BINDER

[75] Inventor: Cheng H. Yu, Hong Kong, Hong Kong

[73] Assignee: World Wide Stationery Manufacturing Company Limited, United Kingdom

[ * ] Notice: The portion of the term of this patent subsequent to Jan. 19, 2010 has been disclaimed.

[21] Appl. No.: 803,339

[22] Filed: Dec. 4, 1991

Related U.S. Application Data

[63] Continuation-in-part of Ser. No. 696,240, May 6, 1991, Pat. No. 5,180,247.

[30] Foreign Application Priority Data

May 3, 1991 [EP] European Pat. Off. ..... 91304057.2

[51] Int. Cl.[5] ..... B42F 3/04

[52] U.S. Cl. ..... 402/41

[58] Field of Search ..... 402/37, 38, 40, 41, 402/39

[56] References Cited

U.S. PATENT DOCUMENTS 3,098,490 7/1963 Wance .
3,101,719 8/1963 Vernon .
3,404,685 10/1968 Vernon .
3,884,586 5/1975 Michaelis et al. .
4,522,526 6/1985 Lozeau et al. .
4,813,803 3/1989 Gross .

FOREIGN PATENT DOCUMENTS 2231536 8/1989 United Kingdom .

*Primary Examiner*—Mark Rosenbaum
*Assistant Examiner*—Willmon Fridie, Jr.
*Attorney, Agent, or Firm*—Wood, Herron & Evans

[57] ABSTRACT

A ring binder includes a base member supporting a plurality of ring members, and an opening mechanism at each end of the base member for opening the plurality of ring members, each opening mechanism including lock means to lock the opening mechanisms in its closed position, the base member comprising a rigid upper structure supporting a pivotable lower structure to which the ring members are mounted, wherein at each end of the binder, the opening mechanism is coupled to and pivotally supported in the lower structure. In another embodiment the opening mechanism has an in-built degree of play before before acting to urge the lower structure to close the ring members for ease of operation.

19 Claims, 9 Drawing Sheets

— Fig. 11 —

RING BINDER

This application is a continuation-in-part of U.S. Ser. No. 696,240, filed May 6, 1991, now U.S. Pat. No. 5,180,247.

This invention relates to a ring binder for loose-leaf binders and the like.

There are a variety of known loose-leaf paper ring mechanisms all of which are movable between a closed position and an open position whereby paper or the like can be removed from the rings.

Such ring mechanisms suffer from the problem that the mechanism can be difficult to open and close, particularly large paper ring mechanisms which have a large closing force to prevent paper falling off the rings. Some known ring mechanisms have attempted to overcome this problem. However, they are complicated in design and have to be manually assembled during manufacture.

It is an object of this invention, to aim to overcome one or more of the above problems.

According to the invention in a first aspect, there is provided a ring binder including a base member supporting a plurality of ring members, the base member comprising a rigid upper structure supporting a pivotable lower structure to which the ring members are mounted, and an opening mechanism at one or each end of the base member for opening the plurality of ring members, characterised in that the opening mechanism is permanently in contact with and pivotably supported by the lower structure.

Preferably the mechanism is coupled to the lower structure in a snap-fit manner.

Suitably, the or each opening mechanism includes at least one projection engaging a corresponding tab formed on the lower structure.

Preferably, the first and second tabs are provided engaging corresponding said projections.

Advantageously, the tabs are formed from resilient material.

Suitably, lock means are provided to lock the opening mechanism in its closed position.

Preferably, the lock means comprises a part of the opening mechanism wedged and positioned at an inwardly directing angle between the upward upper and lower structure of the base member.

Advantageously, the wedged part of the opening mechanism has firstly an upper curved surface portion which is engageable with the corresponding curved upper structure and secondly an engaging member at the bottom thereof which engages the top surface of the lower structure.

Suitably, the lower structure biases said part towards the upper structure and into the locked position.

According to the invention in a second aspect, there is provided a ring binder including a base member supporting a plurality of ring members, the base member comprising a rigid upper structure supporting a pivotable lower structure to which the ring members are mounted and an opening mechanism at one or each end of the base member for opening the plurality of ring members wherein the opening mechanism is pivotable about a fulcrum formed by the upper structure to urge the lower structure from a first to a second stable position and wherein the mechanism is disengaged from the fulcrum in an angular range.

Preferably, the upper structure at said fulcrum is formed with a recessed portion.

Advantageously, the lower structure acts against the upper structure at a non-recessed surface thereof at said first position.

The invention will now be described, by way of example, with reference to the accompanying drawings, in which.

Figure 4:
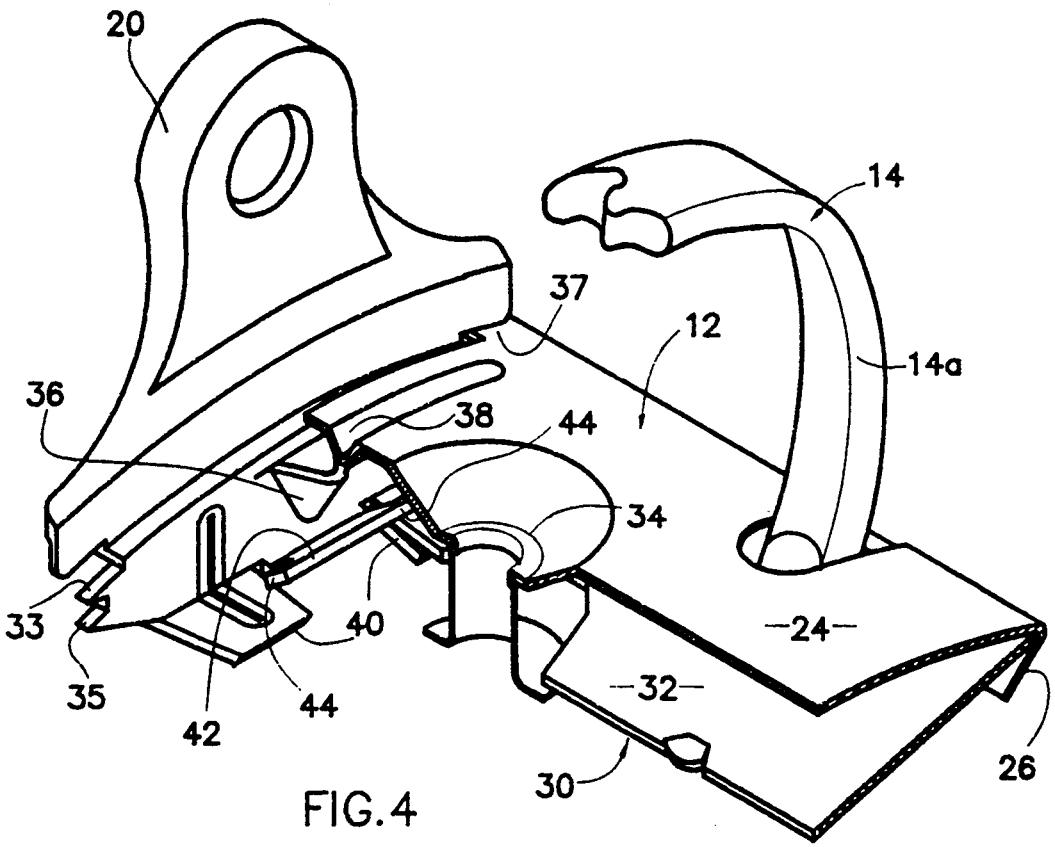
FIG. 4 is a perspective view of the ring binder of FIG. 1 partly in cross-section and in the closed and locked position.
Figure 5:
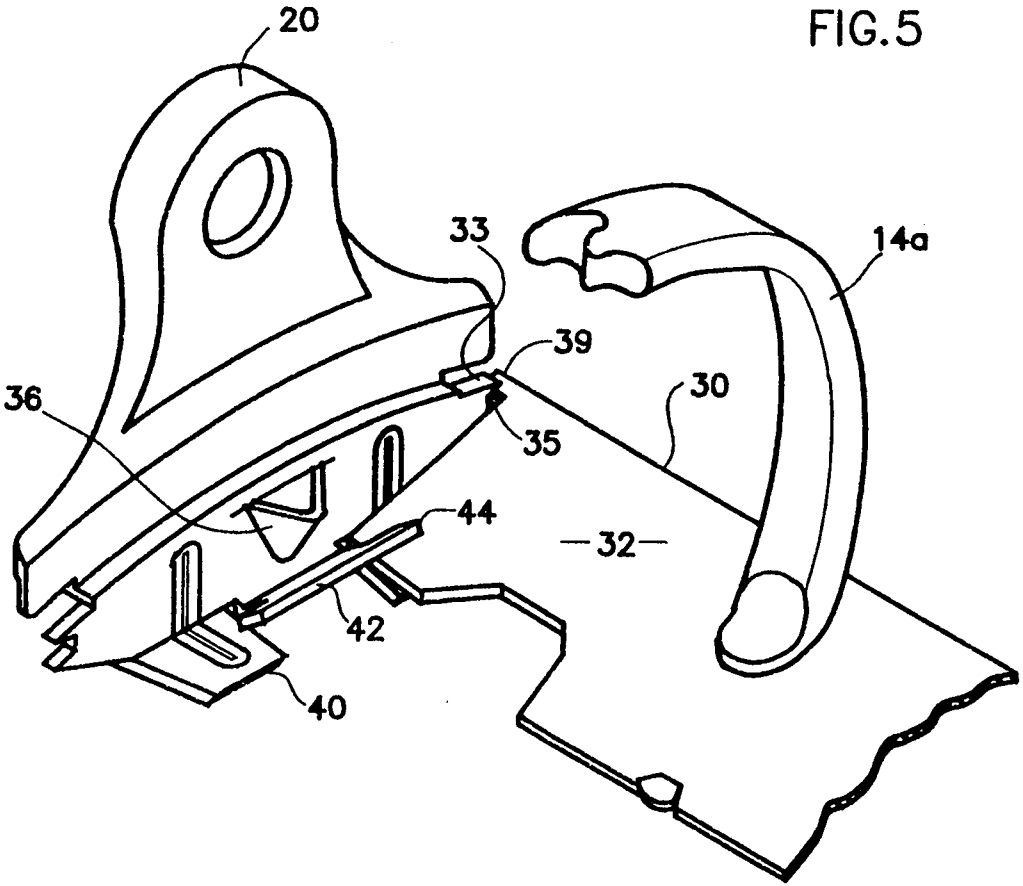
FIG. 5 is a perspective view of the ring binder of FIG. 1 also partly in cross-section and in the closed and locked position.

In FIGS. 1 to 5, a ring binder 10 is shown for a loose-leaf binder comprising a base member 12, three ring members 14 spaced along the base member (one of which is shown in FIGS. 4 & 5), and an opening and locking mechanism 20 at each end of the base member (only one of which is shown).

The base member 12 comprises an upper rigid structure 24 which is curved in cross-section and which supports between its two overlapping sides 26 a pivotable lower structure 30 comprising two carrier rails 32 pivotable to each other along the longitudinal axis of the binder 10.

The ring members 14 are mounted on the pivotable lower structure 30 and in particular, one of the ring components (i.e. component **14*a*) of each ring member is mounted on the carrier rail 32** while the other ring component (not shown) of each ring member is mounted on the other carrier rail (also not shown).

Fastening means 34, meanwhile, are also provided on the upper structure 24 in order to secure the ring binder 10 to a paper folder or the like.

The two carrier rails 32 are movable (i.e. pivoted) relative to each other between a lower position and an upper position due to the action of the opening and locking mechanism 20 on each end of the carrier rails.

The opening mechanism 20 is pivotably supported on each end of the upper rigid structure 24 and is in engagement with each end of the pivotable lower structure 30 in order to position the opening mechanism 20 between the upper and lower structures. In particular, two projections 33 and 35 one above the other (see FIGS. 4 and 5) on each side of the opening mechanism 20 are provided which are internally enclosed by the crimped end 37 of each side 26 of the upper structure 24, while the projections 33 and 35 are externally placed on top of and below, respectively, the outer side ends 39 of the carrier rails 32 in order to engage and position the lower structure 30 relative the upper structure 24, and to pivotally support the opening mechanism 20 between the lower structure 30 and the upper structure 24. Furthermore, the opening mechanism 20 is supported between the upper and lower structure to allow pivotal movement, but otherwise is fixedly mounted therebetween (i.e. no lateral movement etc).

To provide for easy automated mounting of the opening mechanism 20 between the upper and lower structures 24 and 30, the whole outer ends of the upper structure 24 are substantially unobstructed with downwardly depending flaps and the like. As a result, to assemble the opening mechanism 20 to the ring binder, one only needs to place the opening mechanism 20 directly between the upper and lower structures 24 and 30, and then to crimp (i.e. pinch) together the overlapping end 37 of each side 26 of the upper structure. Since the outer ends of the upper structure 24 are substantially unobstructed with downwardly depending flaps and the like, the additional advantage of saving of material is achieved. In this respect, between 2 and 4% saving of material over known arrangements can be obtained.

Figure 1:
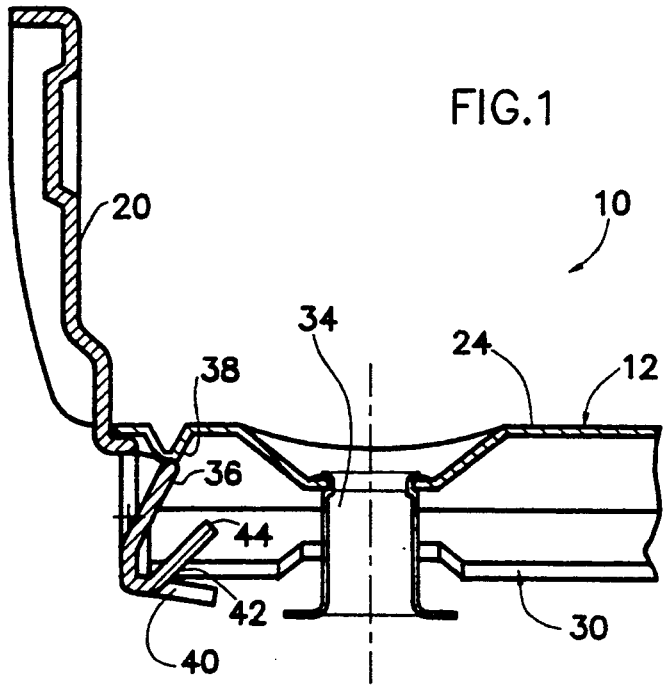
FIG. 1 shows in cross-section the closed and locked position of one end of a first ring binder, not being an embodiment of the invention.
Figure 2:
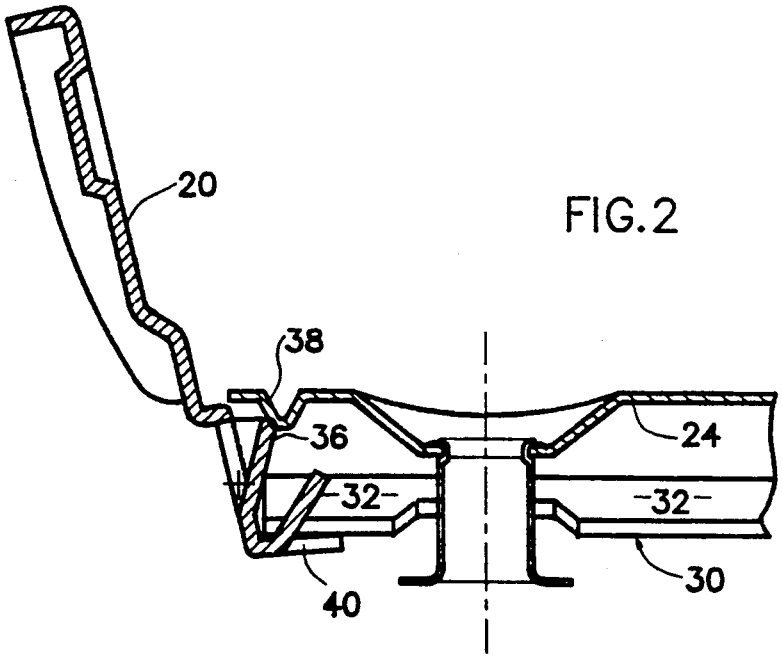
FIG. 2 shows the ring binder of FIG. 1 in the closed and unlocked position.
Figure 3:
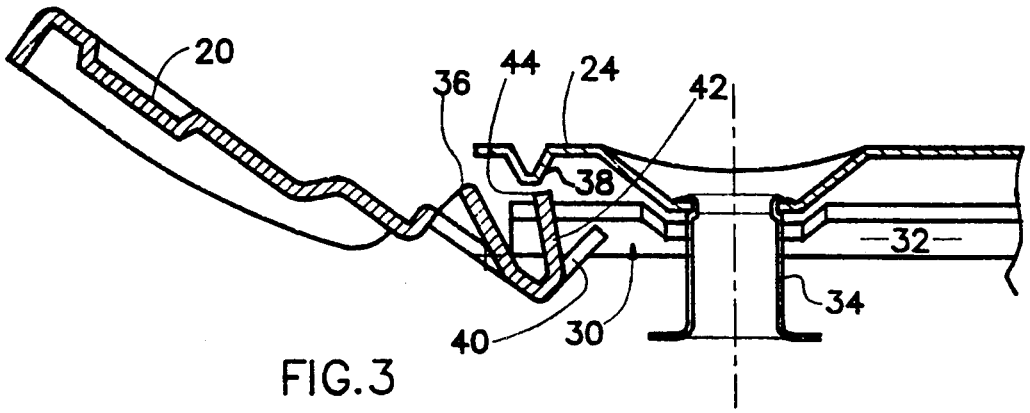
FIG. 3 shows the ring binder of FIG. 1 in the open and unlocked position.

The ring binder has a locked position (see FIG. 1) and two unlocked positions (see FIGS. 2 and 3).

In order to achieve this, the opening mechanism 20 on each end is provided with a first ledge member 36 for cooperating with a lug 38 on the underneath of the upper rigid structure 24 of the base member.

The ring binder has two closed positions (see FIGS. 1 and 2) and an open position (see FIG. 3).

In order to achieve this, the opening mechanism 20 is provided with a second ledge member 40 which is engageable with the underneath of the two pivotable carrier rails 32.

In particular, locking is achieved by the ledge member 36 cooperating with the lug 38 such that in the closed and locked position (see FIG. 1), the ledge member 36 is positioned on one side of the lug 38 whilst in the unlocked position (see FIG. 2), the ledge member 36 is positioned on the other side of the lug 38. In the closed and locked position, the ledge member 40 is not in contact with the underneath of the carrier rails 32 and thus the ring members 14 are in a fully closed position. In the closed and unlocked position, however, the ledge member 40 comes into contact with the underneath of the carrier rails 32 and causes slight upward movement of the carrier rails 32 (but does not cause the carrier rails to pivot upwards).

Opening of the ring members 14, meanwhile is achieved by the opening mechanisms 20 being fully pushed outwards and this causes the ledge member 40 to engage the underneath of the carrier rails 32, whereby these rails flip up (i.e. "snap" pivot) at which point the ring members 14 fully open, and the ring binder 10 is thus then in the open and unlocked position (see FIG. 3).

In addition, the opening/locking mechanism 20 is provided with a third ledge member 42 in order to close the ring members 14 from either the open and unlocked position directly to the closed and locked position, or from the open and unlocked position to the closed and unlocked position. In particular, the third ledge member 42 has outer projections 44 which engage the upper surface of the carrier rails 32 to force the rails to move downwards and pivot downwards.

In FIGS. 6 to 10, a ring binder 50 is shown which is similar in concept to the binder 10 shown in FIGS. 1 to 5. The main difference between the two ring binders is the construction of the opening/locking mechanism 20.

The opening mechanism 20 of the ring binder 50 shown in FIGS. 6 to 10 is pivotally supported on each end of the upper rigid structure 24 and is in engagement with each end of the pivotable lower structure 30 in order to position fixedly the opening mechanism 20 between the upper and lower structures. In particular, a projection 52 (see FIGS. 9 and 10) on each side of the opening mechanism 20 is provided which is internally enclosed by the squashed end 37 (see dotted line in FIG. 9) of each overlapping side 26 of the upper structure 24 while the projections 52 are externally placed at the outer side ends 39 of the carrier rails 32 in order to engage and fixedly position the projection 52 between the lower structure 30 and the upper structure 24. Furthermore, the opening mechanism 20 is supported between the upper and lower structure to allow pivotal movement, but otherwise is fixedly mounted therebetween (i.e. no lateral movement etc).

To provide for easy automated mounting of the opening mechanism 20 between the upper and lower structures 24 and 30, the whole outer ends of the upper structure 24 are substantially unobstructed with downwardly depending flaps and the like. As a result, to assemble the opening mechanism 20 to the ring binder, one only needs to place the opening mechanism 20 directly between the upper and lower structures 24 and 30, and then to crimp (i.e. pinch) together the overlapping end 37 of each side 26 of the upper structure. Since the outer ends of the upper structure 24 are substantially unobstructed with downwardly depending flaps and the like, the additional advantage of saving of material is achieved. In this respect, between 2 and 4% saving of material over known arrangements can be obtained.

The ring binder 50 has two closed positions (see FIGS. 6 and 7) and an open position (see FIG. 8) similar to the ring binder 10 of FIG. 1.

In order to achieve this the opening mechanism 20 on each end is provided with two distinct engagement means, namely first engagement means in the form of a ledge 54 for cooperating with the underneath surface of the pivotable carrier rails 32, and second engagement means also in the form of a ledge member 56 which is engageable with the upper surface of the pivotable carrier rails 32.

Figure 6:
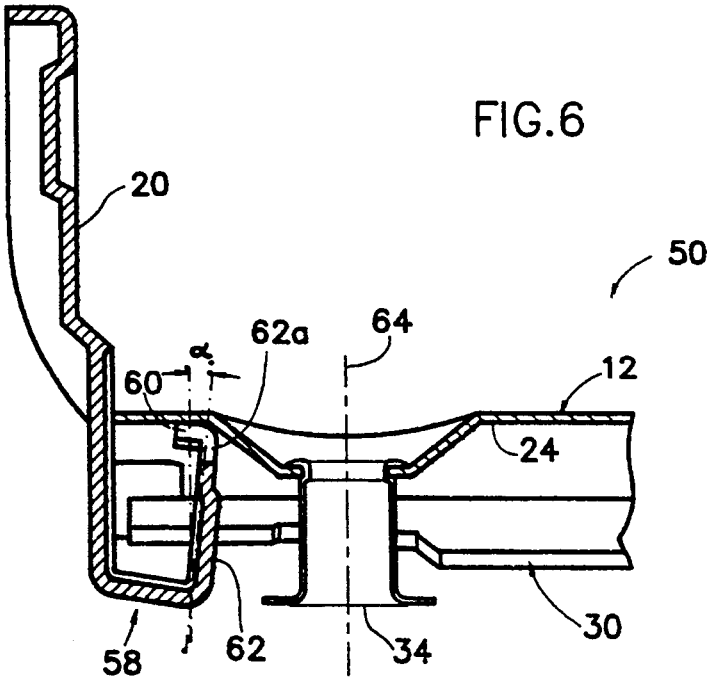
FIG. 6 shows in cross-section the closed and locked position of one end of a second ring binder not being an embodiment of the invention.
Figure 7:
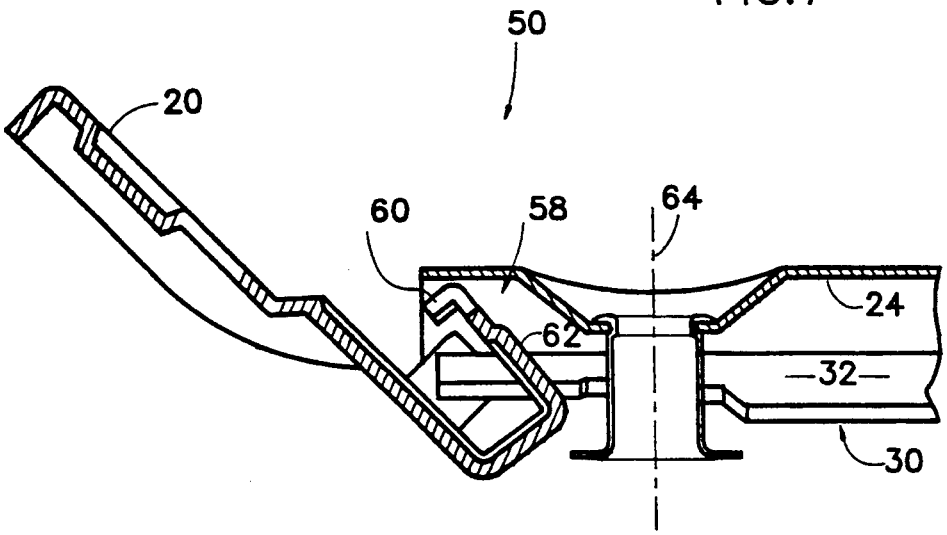
FIG. 7 shows the ring binder of FIG. 6 in the closed and unlocked position.
Figure 8:
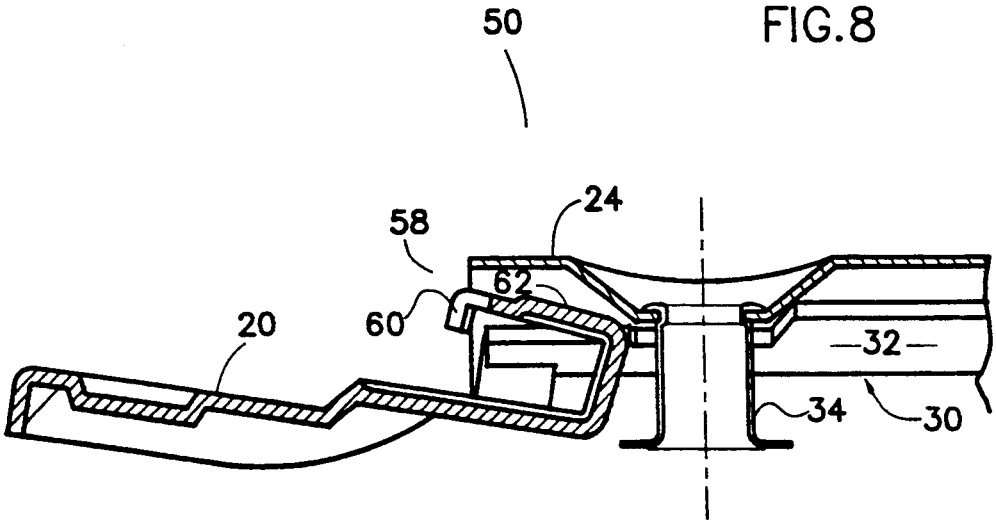
FIG. 8 shows the ring binder of FIG. 6 in the open and unlocked position.
Figure 9:
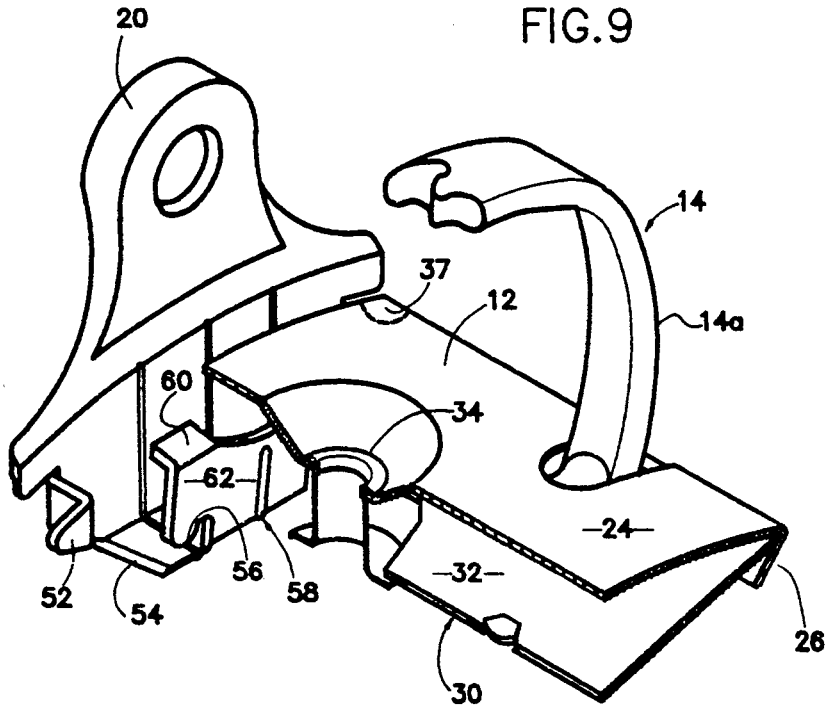
FIG. 9 is a perspective view of the ring binder of FIG. 6 partly in cross-section and in the closed and locked position.
Figure 10:
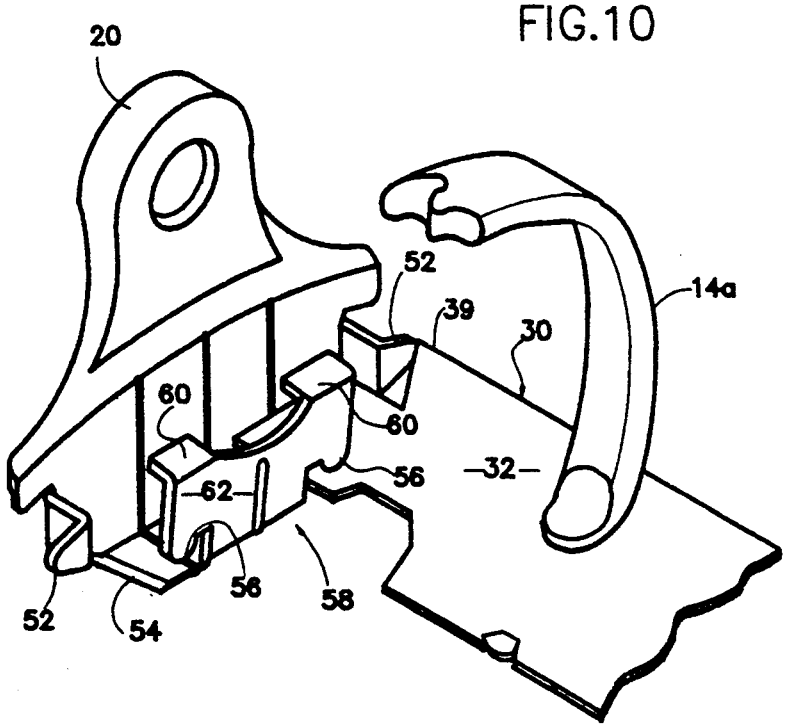
FIG. 10 is a perspective view of the ring binder of FIG. 6 also partly in cross-section and in the closed and locked position.

In particular, the ledge 54 engages the underneath of the carrier rails 32 at the closed position shown in FIG. 7, and further movement of the lever 20 outwardly causes the ledge 54 to push up the underneath of the carrier rails to the open position shown in FIG. 8. Thereafter when the opening mechanism is pulled inwardly to close the rings, the ledge 56 acts on the top of the carrier rails 32 in the open position shown in FIG. 8 to push down the carrier rails 32 to the closed position shown in either FIG. 6 or 7.

The ring binder 50 also has a locked position (see FIG. 6) and two unlocked positions (see FIGS. 7 and 8), similar to the binder 10 shown in FIG. 1. In particular, the locking mechanism 20 is in a basically "b" shaped section where the top of a base portion 58 of the "b" shaped section is provided with a couple of flat surfaces 60 which act against the underneath of the upper structure 24. In the unlocked position of FIG. 7, this top surface 60 is disengaged from the underneath of the upper structure 24; however, once the locking member 20 is moved inwardly, this upper surface 60 comes into contact with the upper structure 24, preferably at the same time as the ledge 56 on the base portion 58 comes into contact with the top of the carrier rails 32.

In particular, it will be seen from FIG. 6 that a front wall 62 of the base portion 58 of the opening mechanism is over centre by an angle $\alpha$, and inwardly directed for instance towards the axis 64 of the fastening means 34 in order to give inherent resistance to unlocking of the opening mechanisms 20. Thus, if the paper held by the rings 14 exerts even large forces tending to open the rings, the mechanism 20 will resist this when in their locked position because such forces will tend to force the front wall 62 to move to the right in the sense viewed in FIGS. 6, so wedging/jamming the front wall 62 of the base portion 58 between the upper structure 24 and the carrier rails 32 and so tending to keep the mechanisms 20 in their locked positions. In particular, the distance along the front wall 62 between the flat surface 60 and the bottom of ledge 56 is slightly greater than the distance between the upper structure 24 and the lower carrier rails 32 when depressed downwards, such that a locking and wedging/jamming effect is achieved.

The upper end 62*a* of the wall 62 is smoothly rounded so that, when the mechanism 20 is moved it does not cut or scar the underside of the base member 12.

The advantage of locking the ring binders 10 and 50 is that the binders are easy to open and the papers within the ring binder will not become dislodged from the ring members, whilst the advantage of supporting the opening mechanism externally of the lower structure and internally of the upper structure is that the ring binder can be assembled by a machine.

Figure 11:
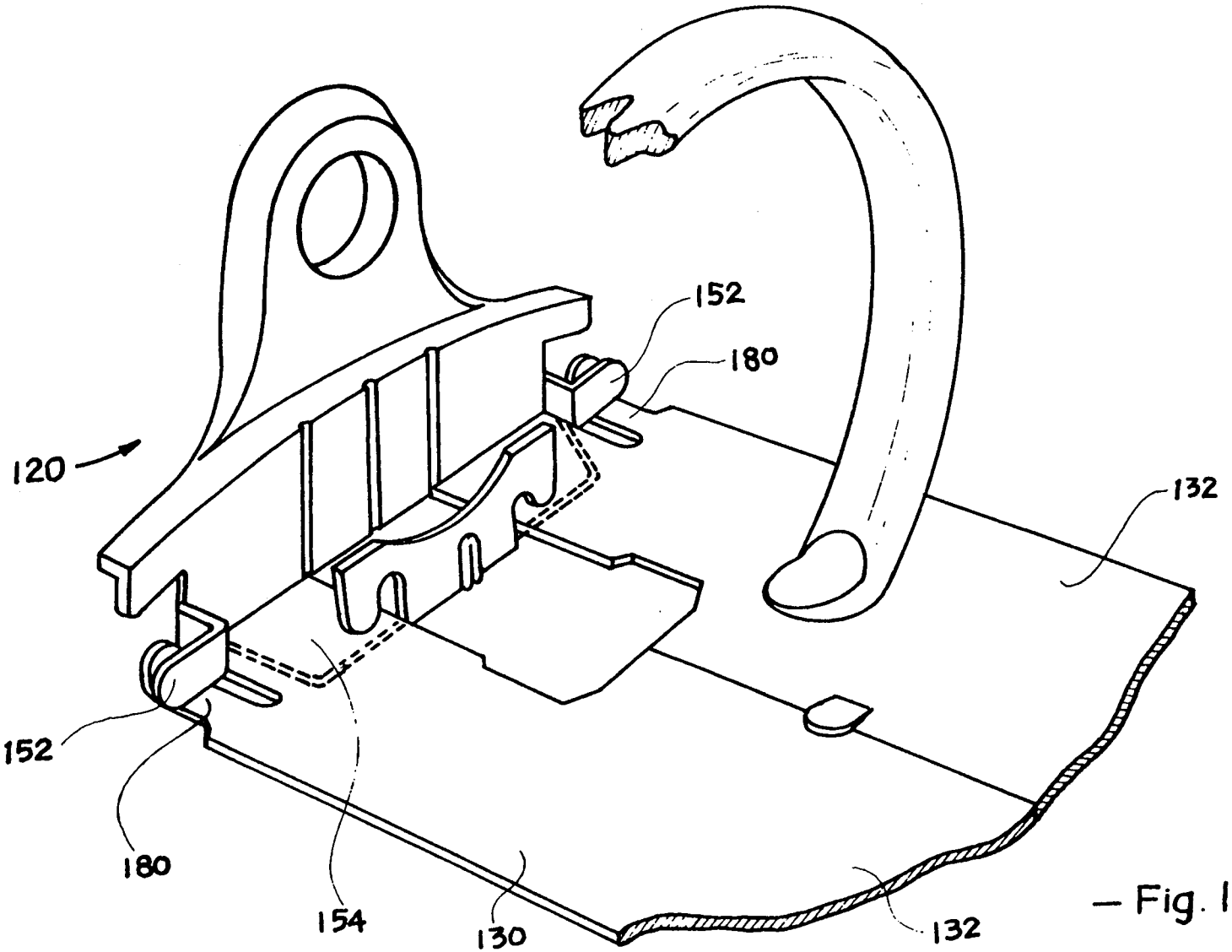
FIG. 11 is a perspective view of a ring binder in accordance with the invention partly in cross-section and in a closed and locked position.
Figure 12:
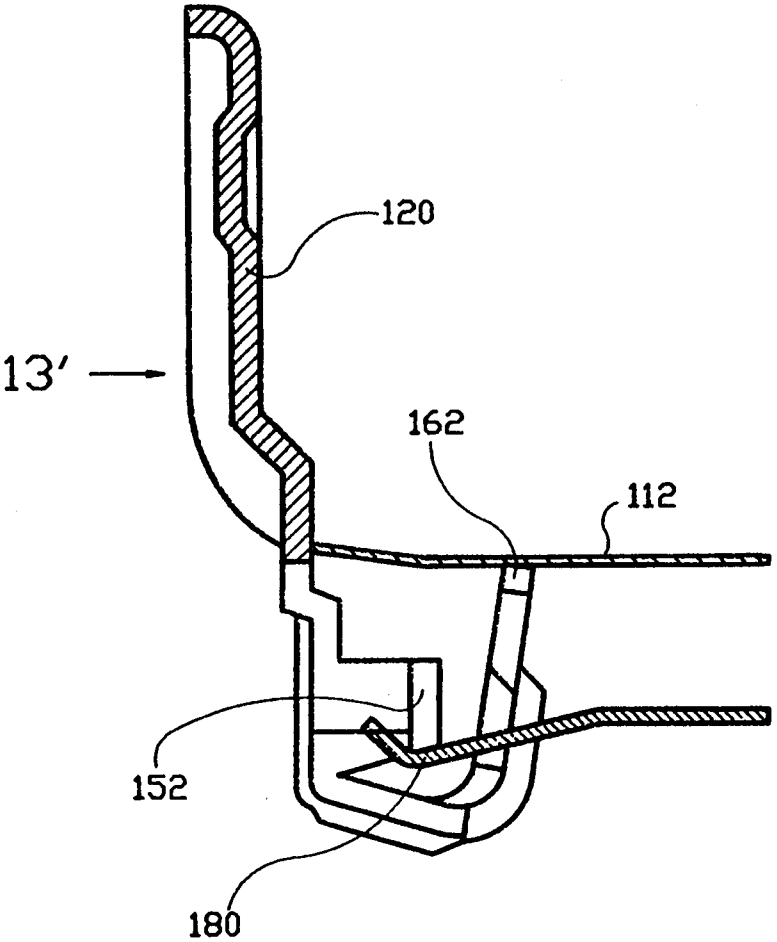
FIG. 12 is a cross-sectional view of one end of the binder of FIG. 11 showing the opening mechanism in the closed and locked position.
Figure 13:
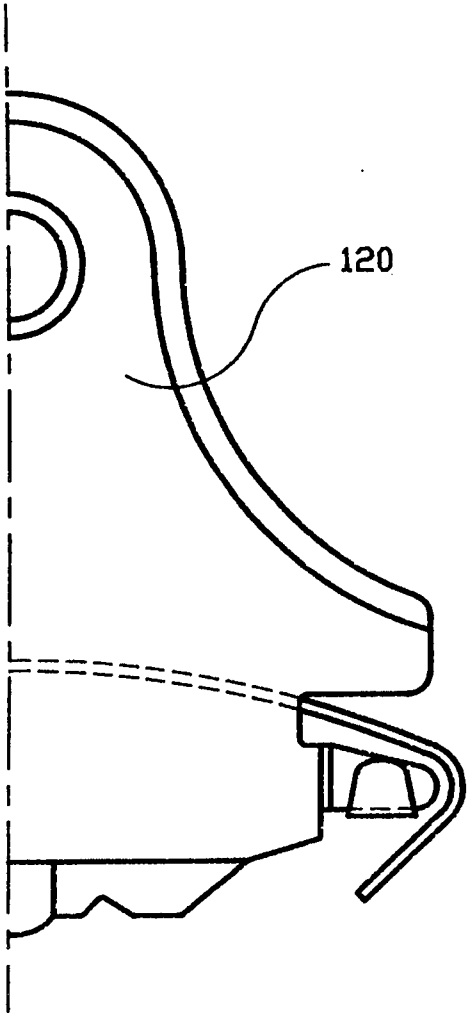
FIG. 13 is a view of the binder of FIGS. 11 and 12 as seen from the direction of arrow 13' of FIG. 12.

A first embodiment of the invention is illustrated in FIGS. 11, 12 and 13 in which an opening mechanism is illustrated of similar form to the ring binder shown in FIGS. 6–10. The binder of FIGS. 11 to 13, however, provides an alternative means of supporting the opening/locking mechanism. The parts in FIGS. 6–10 which are common to FIGS. 11 to 13 are represented by the reference numerals with the addition of 100.

In the embodiment shown in FIGS. 11 to 13, the lower structure 130 is provided with two outwardly extending tabs 180 which provide support for projections 152 of the opening/locking mechanism 120. The opening mechanism 120 is permanently in contact with and coupled to the lower structure 130, the projections 152 being received on an upper surface of the tabs 180, and ledge 154 (shown in phantom lines but a similar component to ledge 54 in FIG. 10) is held against a lower surface of carrier rails 132.

The tabs 180 are arranged, like carrier rails 132 to be formed from material so that they will resiliently deform to allow the opening/locking member 120 to be clipped in place in a snap fit manner during assembly of the binder.

Once engaged, the opening and locking mechanism is coupled to the lower structure but also may move pivotally about an axis through projections 152 within an angular range.

Assembly of the ring binder in this way prevents the opening mechanism from slipping out of the housing during manufacturing assembly. Furthermore, as shown in FIGS. 12 and 13, when the opening/closing member 120 is in the locked position, as the front wall 162 is wedged against the upper structure 112, the projections 152 are forced against the resilient tabs 180 which provide, firstly, a measure of resistance while locking, giving a feeling for the user that the ring binder is tightly locked, and secondly a biasing force acting to hold the over centre wall 162 in position.

If the over centre angle of wall 162, shape of the upper structure 112 and elasticity of the tabs 180 are judiciously chosen, the opening/locking mechanism has a snap action when locking.

Figure 14B:
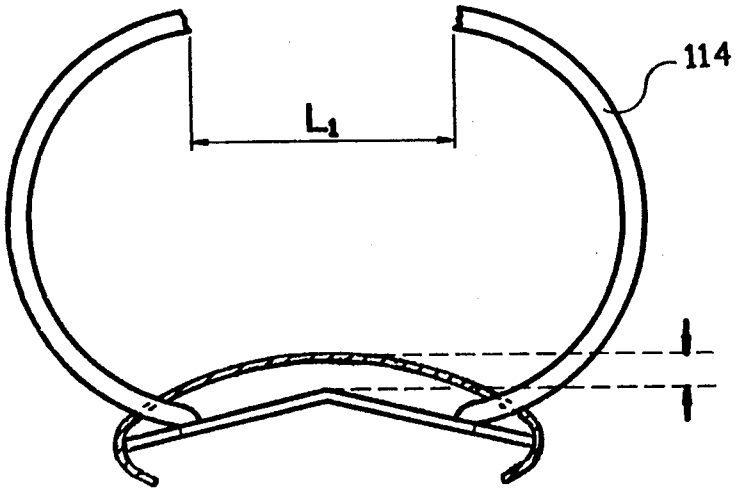
FIGS. 14A and 14B illustrate the ring-binder shown in FIGS. 6–9 with FIG. 14A being a cross-sectional view and FIG. 14B being a schematic end view.
Figure 14A:
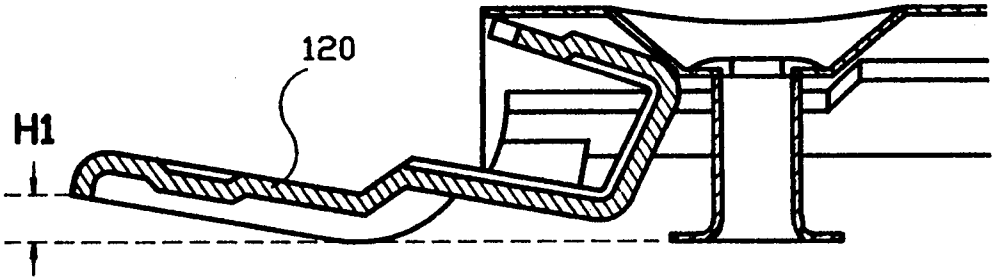

A second embodiment of the invention is illustrated in FIGS. 14 and 15. FIGS. 14A and 14B illustrate a locking mechanism similar to that shown in FIGS. 6–10. One problem with such a locking mechanism is that when the ring binder is opened as shown in these FIGS. 6–10, the opening and locking mechanism 20 is forced to adopt a position as shown in FIG. 14A in which there is only a small gap H1 between the outer edge of the mechanism 20 and the level at which the binder 10 is connected to a surrounding cover (not shown) or surface on which the cover is placed. The opening/locking mechanism 20 is thus difficult to operate from this position unless the opening L1 of the rings 14 is reduced to allow the mechanism 20 to incline upwardly which reduces the available opening to place papers on the ring binder.

Figure 15B:
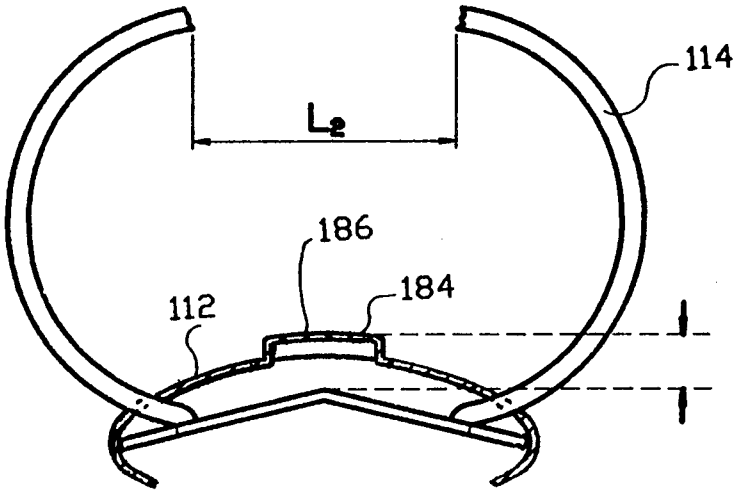
FIGS. 15A and 15B illustrate the ring binder of FIGS. 11 to 13, with FIG. 15A being a cross-sectional vein and FIG. 15B being a schematic end view.
Figure 15A:
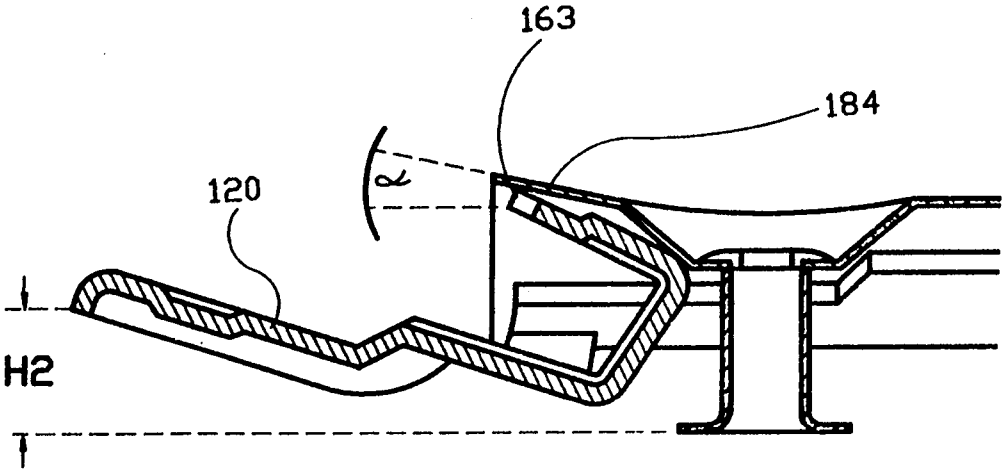

As shown in FIGS. 15A and 15B, in accordance with a second embodiment of the invention, the upper structure 112 is provided with a lip 184 forming an outwardly directed recess 186. This recess allows the mechanism 120 to have a range of pivotal movement to provide a degree of play before inclined end 163 engages portion 184 of the upper structure (the portion 184 acting as a fulcrum point against which the opening/locking mechanism can purchase to force the lower pivotable structure to move downwards thus closing the rings 114). In other words, the opening/locking mechanism 120 is pivotable about the portion 184 of the upper structure to urge the lower structure to move from a first stable position (e.g. the open and unlocked position) to a second stable position (e.g. the closed and unlocked position), the opening/locking mechanism 120 being disengaged from the portion 184 in an angular range (i.e. between the partly open the binder—see for example FIG. 8)

This range of free pivoted movement allows the gap H1 between the mechanism and the cover (see dotted line) as the mechanism engages the upper structure, to be increased to H2, as shown in FIG. 15*a*, whilst allowing the opening L2 in the binder of FIG. 15*b* to remain the same as opening L1 in the binder of FIG. 14*b*.

In the closed and locked position (see FIG. 12), it will be noted that the mechanism 120 is not in contact with the recessed portion 184, but rather is in contact with the unrecessed part of the upper structure.

I claim:

1. A ring binder including a base member supporting a plurality of ring members, the base member comprising a rigid upper structure supporting a pivotable lower structure to which the ring members are mounted, an opening mechanism at one or each end of the base member for opening the plurality of ring members, wherein the sides of the opening mechanism are permanently in contact with and pivotably supported on and by the lower structure, and lock means to lock the opening mechanism in its closed position.

2. A binder as claimed in claim 1 wherein the opening mechanism is coupled to the lower structure in a snap fit manner.

3. A binder as claimed in claim 1 wherein at least one of the sides of the opening mechanism engages a corresponding tab formed on the lower structure.

4. A binder as claimed in claim 3 wherein first and second tabs are provided engaging corresponding said projections.

5. A binder as claimed in claim 3 wherein the tabs are formed from resilient material.

6. A binder a claimed in claim 1 wherein the lock means comprises a part of the opening mechanism wedged and positioned at an inwardly directing angle between the upper and lower structure of the base member.

7. A ring binder as claimed in claim 6 wherein the wedged part of the opening mechanism has firstly an upper curved surface portion which is engageable with the corresponding curved upper structure and secondly an engaging member at the bottom thereof which engages the top surface of the lower structure.

8. A binder as claimed in claim 6 wherein the lower structure biases said part towards the upper structure and into the locked position.

9. A ring binder as claimed in claim 1 wherein the opening mechanism is pivotable about a fulcrum formed by the upper structure to urge the lower structure from a first to a second stable position, and wherein the mechanism is disengaged from the fulcrum in an angular range.

10. A binder as claimed in claim 9 wherein the upper structure at said fulcrum is formed with a recessed portion.

11. A ring binder as claimed in claim 10 wherein the lower structure acts against the upper structure at a non-recessed surface thereof at said first position.

12. A ring binder including a base member supporting a plurality of ring members, the base member comprising a rigid upper structure supporting a pivotable lower structure to which the ring members are mounted and an opening mechanism at one or each end of the base member for opening the plurality of ring members wherein the opening mechanism is pivotable about a fulcrum formed by the upper structure to urge the lower structure from a first to a second stable position, wherein the mechanism is disengaged from the fulcrum in an angular range, and wherein the fulcrum is at an angle relative to the rest of the upper structure.

13. A binder as claimed in claim 12 wherein the upper structure at said fulcrum is formed with a recessed portion.

14. A ring binder as claimed in claim 13 wherein the lower structure acts against the upper structure at a non-recessed surface thereof at said first position.

15. A ring binder as claimed in claim 12 further comprising lock means to lock the opening mechanism in its closed position.

16. A binder a claimed in claim 15 wherein the lock means comprises a part of the opening mechanism wedged and positioned at an inwardly directing angle between the upper and lower structure of the base member.

17. A ring binder as claimed in claim 16 wherein the wedged part of the opening mechanism has firstly an upper curved surface portion which is engageable with the corresponding curved upper structure and secondly an engaging member at the bottom thereof which engages the top surface of the lower structure.

18. A binder as claimed in claim 16 wherein the lower structure biases said part towards the upper structure and into the locked position.

19. A binder as claimed in claim 15 wherein the upper structure at said fulcrum is formed with a recessed position, and wherein the lock means is not in contact with the recessed position in the closed position.

* * * * *

UNITED STATES PATENT AND TRADEMARK OFFICE

CERTIFICATE OF CORRECTION

PATENT NO. : 5,354,142

DATED : October 11, 1994

INVENTOR(S) : Cheng Hung Yu

It is certified that error appears in the above-indentified patent and that said Letters Patent is hereby corrected as shown below:

At Column 6, lines 59 and 60 please delete "partly open the binder" and insert in its place --partly open position shown in Fig. 15a and the fully open position of the binder--

Signed and Sealed this

Twenty-first Day of March, 1995

*Attest:*

Bruce Lehman

BRUCE LEHMAN

*Attesting Officer*

*Commissioner of Patents and Trademarks*